US008288331B2

(12) United States Patent
Hanai et al.

(10) Patent No.: US 8,288,331 B2
(45) Date of Patent: Oct. 16, 2012

(54) LIQUID DETERGENT COMPOSITION COMPRISING A HYDROPHOBIC ORGANIC SOLVENT

(75) Inventors: Junya Hanai, Wakayama (JP); Toshiharu Noguchi, Wakayama (JP); Kazunori Tsukuda, Tokyo (JP)

(73) Assignee: Kao Corporation, Tokyo (JP)

( * ) Notice: Subject to any disclaimer, the term of this patent is extended or adjusted under 35 U.S.C. 154(b) by 426 days.

(21) Appl. No.: 11/993,698

(22) PCT Filed: Jun. 20, 2006

(86) PCT No.: PCT/JP2006/312678

§ 371 (c)(1), (2), (4) Date: May 28, 2008

(87) PCT Pub. No.: WO2006/137554

PCT Pub. Date: Dec. 28, 2006

(65) Prior Publication Data

US 2010/0152090 A1 Jun. 17, 2010

(30) Foreign Application Priority Data

Jun. 22, 2005 (JP) ..... 2005-181734

(51) Int. Cl.
*C11D 3/18* (2006.01)
*C11D 3/44* (2006.01)

(52) U.S. Cl. ..... 510/213; 510/199; 510/245; 510/251; 510/271; 510/362; 510/421; 510/422; 510/426; 510/427; 510/432; 510/490; 510/504

(58) Field of Classification Search ..... 510/362, 510/199, 213, 245, 251, 271, 421, 422, 426, 510/427, 432, 490, 504
See application file for complete search history.

(56) References Cited

U.S. PATENT DOCUMENTS

| | | | |
|---|---|---|---|
| 2005/0003989 | A1 | 1/2005 | Noguchi et al. |
| 2006/0105933 | A1 | 5/2006 | Hayashi et al. |

FOREIGN PATENT DOCUMENTS

| | | | |
|---|---|---|---|
| EP | 1 365 013 | A1 | 11/2003 |
| EP | 1 466 960 | A1 | 10/2004 |
| JP | 5-279699 | | 10/1993 |
| JP | 5-320694 | | 12/1993 |
| JP | 6-336598 | | 12/1994 |
| JP | 7-310099 | | 11/1995 |
| JP | 9-59695 | | 3/1997 |
| JP | 9-509438 | | 9/1997 |
| JP | 9-310100 | | 12/1997 |
| JP | 10-1698 | | 1/1998 |
| JP | 2000-96086 | | 4/2000 |
| JP | 2000-303095 | | 10/2000 |
| JP | 2001-19999 | | 1/2001 |
| JP | 2001-98296 | | 4/2001 |
| JP | 2001-247449 | | 9/2001 |
| JP | 2001-247899 | | 9/2001 |
| JP | 2001-342500 | | 12/2001 |
| JP | 2003-13092 | | 1/2003 |
| JP | 2003-522285 | | 7/2003 |
| JP | 2004-182760 | | 7/2004 |
| JP | 2004-262955 | | 9/2004 |
| JP | 2004-323835 | | 11/2004 |
| JP | 2005-53971 | | 3/2005 |
| JP | 2005-60450 | | 3/2005 |
| JP | 2005060450 | A * | 3/2005 |
| WO | WO 95/04807 | | 2/1995 |
| WO | WO 01/59059 | A1 | 8/2001 |

OTHER PUBLICATIONS

Office Action issued Oct. 4, 2011 in Japan Application No. 2006-156049 (With English Translation).

* cited by examiner

*Primary Examiner* — Charles Boyer
(74) *Attorney, Agent, or Firm* — Oblon, Spivak, McClelland, Maier & Neustadt, L.L.P.

(57) ABSTRACT

The present invention relates to a liquid detergent composition containing (a) a specific compound having one alkyl group selected from a 2-ethylhexyl group, an isononyl group and an isodecyl group, (b) a surfactant selected from anionic surfactants and amphoteric surfactants, (c) a hydrophobic organic solvent that is liquid at 20° C., and (d) water in specific ratios.

18 Claims, No Drawings

LIQUID DETERGENT COMPOSITION COMPRISING A HYDROPHOBIC ORGANIC SOLVENT

FIELD OF THE INVENTION

The present invention relates to a liquid detergent composition.

BACKGROUND OF THE INVENTION

Hydrophobic solvents such as terpene hydrocarbons and paraffins have good detergency to sebum stains, soap scum, denatured oils, grease, oils, and the like, and are widely used in liquid detergents. For example, JP-A-2001-19999 discloses a water-dispersible detergent for removing oil stains containing a terpene compound and a surfactant. JP-A-2001-98296, JP-A-2000-96086, JP-A-2000-303095, JP-A-10-1698, JP-A-06-336598, JP-A-05-279699, and JP-A-09-509438 disclose detergents containing terpene compounds. These patents disclose simultaneous use of a glycol ether solvent in the Detailed Description of the Invention and Scope of Claim for a patent thereof. JP-A-2001-247449, JP-A-2001-342500, JP-A-07-310099, and JP-A-05-320694 disclose detergents containing terpene compounds and glycol solvents. JP-A-2001-247899, JP-A-09-59695, and JP-A-09-310100 discloses detergents containing terpene hydrocarbons and nonionic surfactants. JP-A 2003-522285 discloses a detergent containing oil and a mixture of nonionic surfactants. EP-A 1466960 discloses a liquid detergent composition containing a nonionic compound such as a polyoxyalkylene alkyl ether having a branched chain including a 2-ethylhexyl, an isononyl, or an isodecyl group, a nonionic surfactant, and a hydrophobic organic solvent. EP-A 1365013 discloses a liquid detergent composition containing a nonionic polyol compound bearing an alkyl group having 3 to 11 carbon atoms of which at least one is secondary, tertiary, or quaternary, a hydrophobic organic solvent, and water.

JP-A-2004-182760 discloses a detergent composition containing an amphoteric surfactant, an anion surfactant, mono-2-ethylhexyl glyceryl ether or mono-2-ethylhexanoic acid glyceride, and water.

SUMMARY OF THE INVENTION

The present invention relates to a liquid detergent composition containing (a) at least one compound selected from the following (a1) and (a2) [hereinafter, referred to as component (a)], (b) at least one surfactant selected from anionic surfactants and amphoteric surfactants [hereinafter, referred to as component (b)], (c) a hydrophobic organic solvent that is liquid at 20° C. [hereinafter, referred to as component (c)], and (d) water [hereinafter, referred to as component (d)], in which [(a)+(b)]/(c) (mass ratio) is 2.5 or less, (b)/(a) (mass ratio) is 0.1 or more, (a)/(c) (mass ratio) is 0.1 or more, and [(a)+(b)]/the total surfactants (mass ratio) is 0.7 to 1.

(a1): a polyoxyalkylene alkyl ether having one alkyl group selected from a 2-ethylhexyl group, an isononyl group and an isodecyl group, in which an average added mole number of alkylene oxides having 2 or 3 carbon atoms is 2 to 6 [hereinafter, referred to as component (a1)]

(a2): a compound represented by formula (I) [hereinafter, referred to as the (a2)]

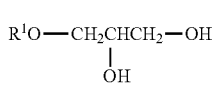

(I)

[wherein, $R^1$ is an alkyl group selected from a 2-ethylhexyl, an isodecyl, and an isononyl groups.]

The present invention further provides use of the liquid detergent composition for washing hard surfaces and a method for washing hard surfaces by applying the liquid detergent composition to hard surfaces.

DETAILED DESCRIPTION OF THE INVENTION

Hydrophobic solvents have small affinity to water, and when used in aqueous compositions, they are generally used together with surfactants. To achieve good detergency to sebum stains and soap scum attached to hard surfaces, a surfactant used together with a hydrophobic solvent (when several surfactant are used, including a combination thereof) must be selected so as not to impair the original performance of the hydrophobic solvent. It is also desired on the cost front to decrease the amount of the surfactant. The present inventors had previously found that by using a compact compound having an alkyl chain of 3 to 11 carbon atoms, particularly 4 to 8 carbon atoms, and hydroxy groups and a surfactant, performance of a hydrophobic solvent can be sufficiently achieved (EP-A 1466960 and EP-A 1365013). However, an increase of an amount of the hydrophobic solvent added leads to the increase of concentrations of the compound having hydroxy groups as a stabilizer and the surfactant. In EP-A 1466960, to improve stability to avoid phase separation between the hydrophobic solvent and water and the like, a nonionic surfactant is used. When the amount of the hydrophobic solvent is increased, the amount of a stabilizer such as the nonionic surfactant also must be increased, or poor storage stability is provided and an effect of improving detergency is decreased. EP-A 1365013 describes that the simultaneous use of a water-soluble solvent such as glycol ether can increase storage stability. However, a large amount of hydrophobic solvent limits reduction of the polyol compound.

JP-A-2004-182760 discloses no liquid hydrophobic organic solvent.

The present invention provides a liquid detergent composition containing a specific hydrophobic solvent exhibiting both liquid phase stability (hereinafter, also referred simply to as stability) such that the liquid phase is uniform and does not separate in a stationary preservation with a smaller amount of the surfactant and good detergency.

According to the present invention, a liquid detergent composition for hard surfaces can be obtained with a smaller amount of a surfactant, which has good detergency particularly to soap scum or denatured oil stains on hard surfaces, is homogeneous, and is excellent in stability.

<Component (a)>

Component (a) in the liquid detergent composition of the present invention is a compound having a tendency of orienting in the interface between the hydrophobic organic solvent which is component (c) of the present invention and water. The different point of component (a) and usual surfactants is that since component (a) has a hydrophobic part of a specific branched alkyl group and a hydrophilic part of a limited number of hydroxy groups, component (a) is difficult to be included in component (c), while being difficult to form a rigid micelle, and thus the hydrophobic solvent, component (c), does not lose its potential to oil stains.

Component (a1) will be described in detail below. The alkylene oxide having 2 or 3 carbon atoms of component (a1) is ethylene oxide [hereinafter, referred to as EO] or propylene oxide [hereinafter, referred to as PO]. Since PO is more hydrophobic, an average add mole number of PO is preferably 0 to 2, and a structure definitely containing EO is preferred. In the present invention, preferred are those in which alkylene oxides are mainly EO, and more preferred are those in which all alkylene oxides are EO. An average added mole number of alkylene oxide is 1 to 6 moles, and preferably 2 to 4 moles.

Component (a1) having a 2-ethylhexyl group can be obtained by subjecting n-butylaldehyde to aldol condensation and hydrogenating to provide 2-ethyl-1-hexanol, and adding an alkylene oxide to 2-ethyl-1-hexanol.

Component (a1) having an isononyl group can be obtained by converting diisobutylene through hydroformylation by the oxo process followed by hydrogenation to isononyl alcohol, and adding an alkylene oxide to isononyl alcohol. The isononyl alcohol is mainly composed of 3,5,5-trimethyl-1-hexanol.

Component (a1) having an isodecyl group can be obtained by converting nonene through hydroformylation by the oxo process followed by hydrogenation to isodecanol, and adding an alkylene oxide to isodecanol. The isodecanol is a mixture of many isomers having branched methyl at various positions. Typical structure thereof is 8-methyl-1-nonanol.

Component (a1) of the present invention is preferably polyethylene glycol-2-ethylhexyl ether (average added mole number of EO=2 to 6).

Next, component (a2) will be described in detail. A compound of component (a2) can be produced by reacting an alcohol represented by $R^1OH$ with an epoxy compound such as epihalohydrin and glycidol in the presence of a Lewis acid catalyst such as $BF_3$. In the reaction, an aluminium catalyst described in WO-A98/50389 may be used. In the present invention, $R^1OH$ is even more preferably 2-ethyl-1-hexanol.

In production of component (a2), an epoxy compound, such as epihalohydrin and glycidol, is added to $R^1OH$ described above with the above-mentioned catalyst. In the reaction, the epoxy compound is generally used in an excess amount of 1 to 5 moles to $R^1OH$. Thus the compound of formula (I) and multi-adducts derived from the compound of formula (I) by further addition of epoxy compounds are produced. The present invention does not deny a coexistence of multi-adducts. However, multi-adducts/component (a2) (mass ratio) is preferably controlled to 0.3 or less, more preferably 0.1 or less, and even more preferably 0.05 or less. The control of a content of multi-adducts can be achieved by a method of using a catalyst described in WO-A98/50389, a method of purification such as distillation, and the like. A mass ratio of multi-adducts can be determined by gas chromatography.

Component (a) of the present invention described above is capable of homogeneously dispersing the hydrophobic solvent, component (c), in an aqueous solution without affecting properties of component (c).

<Component (b)>

Examples of the anion surfactant of component (b) include at least one compound selected from the following (b1) to (b4).

(b1): alkyl sulfuric ester salts represented by formula (1b)

$$R^2OSO_3M^2 \quad (1b)$$

[wherein, $R^2$ represents a linear or branched alkyl or alkenyl group having 8 to 22 carbon atoms; and $M^2$ represents a hydrogen atom, an alkali metal, ammonia or alkanolamine.]

The alkyl sulfuric ester salt can be obtained by sulfonating a linear or branched primary or linear secondary alcohol having 8 to 22 carbon atoms, preferably 10 to 14 carbon atoms with $SO_3$ or chlorosulfonic acid, and neutralizing.

(b2): polyoxyethylene alkyl ether sulfuric ester salts represented by formula (2b)

$$R^3(OCH_2CH_2)_nOSO_3M^3 \quad (2b)$$

[wherein, $R^3$ represents an alkyl or alkylallyl group having 8 to 22 carbon atoms; n represents an integer of 0 to 16; and $M^3$ represents a hydrogen atom, an alkali metal, ammonia or alkanolamine.]

The polyoxyalkylene alkyl ether sulfuric ester salt can be obtained by adding EO to a linear or branched primary or linear secondary alcohol having 8 to 22 carbon atoms on the average in an average amount of 0.5 to 5 moles per one mole of the alcohol and sulfating the adduct by, for example, a method described in JP-A-09-137188. The alkyl group preferably has 10 to 16 carbon atoms on average. n is preferably 1 to 5.

(b3): fatty acids or a salt thereof represented by formula (3b)

$$R^4COOM^4 \quad (3b)$$

[wherein, $R^4$ represents a linear or branched chain alkyl or alkenyl group having 7 to 17 carbon atoms; and $M^4$ represents a hydrogen atom, an alkali metal, ammonia or an alkanolamine.]

In the fatty acids or a salt thereof, $R^4$ preferably has 9 to 15 carbon atoms, and from the point of stability, more preferably 9 to 13 carbon atoms. Fatty acids, fatty acid sodium salts, fatty acid potassium salts, and the like can be used.

(b4): ether carboxylic acid salts represented by formula (4b)

$$R^5(OCH_2CH_2)_nOCH_2COOM^5 \quad (4b)$$

[wherein, $R^5$ represents an alkyl or alkylallyl group having 8 to 22 carbon atoms; n represents an integer of 0 to 16; and $M^5$ represents a hydrogen atom, an alkali metal, ammonia or alkanolamine.]

The ether carboxylic acid salt can be obtained by, for example, reacting an alcoholate of polyoxyethylene alkyl ether with sodium monochloroacetate. $R^5$ preferably has 10 to 14 carbon atoms. n is preferably 2 to 15, and from the point of stability, more preferably 3 to 12.

Examples of the anionic surfactant of component (b) also include, in addition to the above (b1) to (b4), α-olefin sulfonates, α-sulfofatty acid salts, α-sulfofatty acid lower alkyl ester salts, dialkylsulfosuccinic ester salts, and alkyl- or alkenylsuccinates. An α-olefin sulfonate can be produced by sulfonating an α-alkene having 8 to 18 carbon atoms with $SO_3$ and hydrating/neutralizing. It is a mixture of a compound having a hydroxy group in a hydrocarbon group with a compound having an unsaturated bond in a hydrocarbon group. In an α-sulfofatty acid lower alkyl ester salt, an alkyl group preferably has 10 to 16 carbon atoms, and from the point of detergency effect, a methyl ester or an ethyl ester is preferred. A preferred salt thereof includes a sodium salt, a potassium salt, a magnesium salt, a calcium salt, an alkanolamine salt, and an ammonium salt. In a dialkylsulfosuccinic ester salt, both alkyl groups are preferably 2-ethylhexyl, and a sodium salt is preferred. As an alkyl- or alkenylsuccinate, potassium or sodium alkenylsuccinate having 10 to 14 carbon atoms is preferred.

In component (b), examples of the amphoteric surfactant include at least one compound selected from the following (b5) to (b6).

(b5): carboxybetaine surfactants represented by formula (5b)

$$R^{6a}-[D-R^{6b}]_f-\underset{\underset{R^{6d}}{|}}{\overset{\overset{R^{6c}}{|}}{N^+}}-R^{6e}-COOM^6 \quad (5b)$$

[wherein, $R^{6a}$ is an alkyl or alkenyl group having 9 to 23 carbon atoms; $R^{6b}$ is an alkylene group having 1 to 6 carbon atoms; D is a group selected from —COO—, —CONH—, —OCO—, —NHCO—, and —O—; f is a number of 0 or 1; $R^{6c}$ and $R^{6d}$ are alkyl or hydroxyalkyl groups having 1 to 3 carbon atoms; $R^{6e}$ is an alkylene group having 1 to 5 carbon atoms that may be substituted with a hydroxy group; and $M^6$ represents a hydrogen atom, an alkali metal, ammonia or alkanolamine.]

Examples of the carboxybetaine surfactant include alkyl dimethyl carboxymethyl betaines in which $R^{6a}$ has 10 to 18 carbon atoms (in formula (5b), f is 0, both of $R^{6c}$ and $R^{6d}$ are methyl groups, and $R^{6e}$ is a methylene group) and alkyl amidepropyl carboxybetaines in which $R^{6a}$ has 10 to 18 carbon atoms (in formula (5b), D is —CONH—, $R^{6b}$ is an alkylene group having 3 carbon atoms, f is 1, both of $R^{6c}$ and $R^{6d}$ are methyl groups, and $R^{6e}$ is a methylene group). An alkyl dimethyl carboxymethyl betaine can be obtained by, for example, reacting alkyldimethylamine having 10 to 18 carbon atoms with sodium monochloroacetate. An alkyl amidepropyl carboxybetaine can be obtained by, for example, reacting a fatty acid having 10 to 18 carbon atoms with dimethylaminopropylamine to produce an amide, and reacting the amide with sodium monochloroacetate.

(b6): amine oxide surfactants represented by formula (6b)

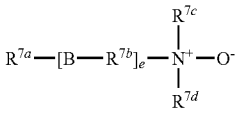

(6b)

[wherein, $R^{7a}$ is a linear alkyl or alkenyl group having 8 to 16 carbon atoms; $R^{7C}$ and $R^{7d}$ are alkyl or hydroxyalkyl groups having 1 to 3 carbon atoms; $R^{7b}$ is an alkylene group having 1 to 5 carbon atoms; B is a group selected from —COO—, —CONH—, —OCO—, —NHCO—, —O—; and e is a number of 0 or 1.]

Examples of the amine oxide surfactant include alkyldimethylamine oxides in which $R^{7a}$ has 10 to 18 carbon atoms (in formula (6b), e is 0, both of $R^{7c}$ and $R^{7d}$ are methyl groups) and alkylamidepropylamine oxides in which $R^{7a}$ has 10 to 18 carbon atoms (in formula (6b), B is —CONH—, $R^{7b}$ is an alkylene group having 3 carbon atoms, e is 1, Both of $R^{7c}$ and $R^{7d}$ are methyl groups). An alkyldimethylamine oxide can be obtained by, for example, reacting an alkyldimethylamine having 10 to 18 carbon atoms with an oxidizing agent such as hydrogen peroxide. An alkylamidepropylamine oxide can be obtained by, for example, reacting a fatty acid having 10 to 18 carbon atoms with dimethylaminopropylamine to give an amide, and oxidizing the amide with an oxidizing agent such as hydrogen peroxide.

From the point of being able to decrease an amount of surfactant required for stabilization, component (b) preferably includes alkylsulfuric ester salts having a linear or branched alkyl group having 10 to 14 carbon atoms, polyoxyethylenealkylsulfuric ester salts having a linear or branched alkyl group having 10 to 14 carbon atoms and 1 to 3 of average added mole number of EO, fatty acid sodium salts having an alkyl group having 10 to 14 carbon atoms, polyoxyethylene alkyl ether acetates having an alkyl group having 10 to 14 carbon atoms and 4 to 10 of average added mole number of EO, alkyl amidepropyl carboxybetaines having 10 to 14 carbon atoms, and alkyldimethylamine oxides having 10 to 14 carbon atoms. Among them, alkylsulfuric ester sodium salts having a linear or branched alkyl group having 10 to 12 carbon atoms, polyoxyethylenealkylsulfuric ester sodium salts having a linear or branched alkyl group having 10 to 12 carbon atoms and 1 to 3 of average added mole number of EO, fatty acid sodium salts having an alkyl group having 10 to 14 carbon atoms, polyoxyethylene alkyl ether acetic acid sodium salts having an alkyl group having 10 to 14 carbon atoms and 4 to 10 of average added mole number of EO are more preferred.

<Component (c)>

The hydrophobic organic solvent that is liquid at 20° C. used in the present invention has a solubility parameter determined by the following calculation formula generally well known (hereinafter, referred to as a sp value) of 10.0 to 21.0, preferably 14.0 to 21.0, and more preferably 14.0 to 19.0, and a solubility of 0.5% or less by weight in water at 20° C. By using the hydrophobic organic solvent having the sp value and the solubility in water within the range described, good detergency can be achieved. For determining a sp value, numeric values described in Hoy, K. L., The Hoy Tables of Solubility Parameters, Union Carbide Corporation, Solvents and Coatings Materials Division, South Charlston, W. Va. (1985) are used.

$$\delta=(\Delta H/V)^{1/2}$$

δ; solubility parameter (sp value) $[(J/cm^3)^{1/2}]$

ΔH; molar heat of vaporization

V; molar volume

In a method for measuring the solubility in water, in a 100 mL beaker of 50 mm inner diameter and 70 mm height, the hydrophobic solvent is added in about 50 mL of water, stirred for 10 minutes with a cylindrical stirrer of about 8 mm diameter and about 40 mm length at about 600 rpm, and allowed to stand for 3 hours. Then, the mixture is visually examined and considered as "dissolved" if there is no turbidity or separation.

The hydrophobic organic solvent may have an ether group, an amide group, an ester group, and the like, if it has an sp value within the range described. Examples of component (c) include hydrocarbons having 6 to 30 carbon atoms in the total, monovalent aliphatic alcohols and esters thereof, other fatty acid esters, and aliphatic ketones. In the present invention, hydrocarbons particularly having 8 to 20 carbon atoms, more preferably 8 to 15 carbon atoms are preferred.

Specific examples of the hydrocarbon include olefin hydrocarbons, paraffin hydrocarbons, aromatic hydrocarbons, and terpene hydrocarbons.

Examples of an olefin hydrocarbon that can be used include linear olefin compounds such as, hexene, octene, decene, dodecene, tetradecene; branched olefin compounds such as diisobutylene and triisobutylene; and cyclic olefin compounds such as cyclohexene and dicyclopentene.

Examples of a paraffin hydrocarbon that can be used include linear paraffin compounds such as hexane, heptane, octane, nonane, decane, undecane, dodecane, tridecane, tetradecane, pentadecane, hexadecane, heptadecane and octadecane; branched paraffin compounds such as, isohexane, isoheptane, isooctane, isohexane, isododecane, isotridecane, isotetradecane, isopentadecane, isohexadecane, isoheptadecane, and isooctadecane; and cyclic paraffin compounds such as cyclohexane.

Examples of an aromatic hydrocarbon include toluene, xylene, and cumene.

Examples of the terpene compound that can be used include monoterpene compounds that are isoprene dimers, sesquiterpene compounds that are isoprene trimers, and diterpene compounds that are isoprene tetramers. Specific examples of a preferred terpene compound include α-pinene, β-pinene, camphene, limonene, dipentene, terpinolene, myrcene, β-caryophyllene, cedrene. Limonene, dipentene, and terpinolene are even more preferred.

In the present invention, one or more compounds selected from linear paraffin compounds, branched paraffin compounds, monoterpene compounds, and sesquiterpene compounds are even more preferred. From the point of detergency effect, one or more compounds selected from decane, undecane, dodecane, tridecane, tetradecane, pentadecane, hexadecane, isododecane, isotridecane, isotetradecane, isopentadecane, isohexadecane, isoheptadecane, isooctadecane, limonene, dipentene, and terpinolene are even more preferred.

Component (c) of the present invention is preferably a paraffin compound having a 50% distillation temperature of 150 to 360° C., preferably 170 to 330° C. in accordance with the distillation test of JIS K2254. The compound having a distillation temperature within this range has no problem in scent, good stability, and is excellent in detergency. Normalparaffins having 10 to 20 carbon atoms and isoparaffins having 10 to 20 carbon atoms are preferred, and particularly isoparaffins are more preferred from the point of scent. Specific examples include normalparaffins such as Normalparaffin SL (trade mark), Normalparaffin L (trade mark), Normalparaffin M (trade mark), Normalparaffin MA (trade mark), Normalparaffin H (trade mark), which are manufactured by Nippon Petrochemicals Co., Ltd, N-10 (trade mark), N-11 (trade mark), N-12 (trade mark), N-13 (trade mark), and N-14 (trade mark), which are manufactured by Nikko Sekiyu Kagaku K.K.; and isoparaffins such as Isosol 300 (trade mark), Isosol 400 (trade mark), which are manufactured by Nippon Petrochemicals Co., Ltd, IP Solvent 1620 (trade mark), IP Solvent 2028 (trade mark), IP Solvent 2835 (trade mark), which are manufactured by Idemitsu Sekiyu Kagaku K.K., Shellsol 70 (trade mark), Shellsol 71 (trade mark), and Shellsol 72 (trade mark), which are manufactured by Shell Chemicals Japan Ltd.

Component (c) has properties like an oil, and naturally exhibits better detergency to oil stains than which water exhibits. Specifically, when component (c) alone is used for washing oil stains, it can dissolve denatured oil stains, and allows the stains to be removed easily from a surface to be washed. However, a detergent containing only component (c) has a problem of residual component (c) on a washed surface, and further has disadvantages of safety such as inflammability and of economy. Thus, it is though that a composition containing component (c) dispersed therein with a surfactant is used. However, when component (c) is simply dispersed in a composition with a surfactant, properties of component (c) are changed and the composition cannot exhibit its original detergency. The present invention has accomplished an aqueous detergent composition containing the hydrophobic solvent as component (c) with smaller amounts of surfactants (a) and (b) than those conventionally used without impairing properties of the hydrophobic solvent. In addition, surprisingly, the present invention has significance in establishing a composition capable of reducing the amount of surfactants (the total amount of (a)+(b)) within a range that stabilization of component (c) can be achieved and providing high detergency while an amount of component (c) is the same by using a specific combination of surfactants (a) and (b).

<Component (d)>

Component (d) of the present invention is water. Examples of water that can be used include ion-exchanged water in which a trace amount of metal components is removed, distilled water, and sterile water sterilized with hypochlorites and chlorine.

<Other Components>

In the present invention, mainly for the purpose of improving bactericidal performance, a surfactant (hereinafter, referred to as component (e)) other than components (a) and (b) may be contained to such degree that does not impair the effect of the invention. The surfactant can be selected from those known to be generally used in detergents. Preferred examples of component (e) include cationic surfactants.

From the points of detergency effect and bactericidal effect, preferably used as cationic surfactants are compounds represented by formula (e1) to (e3).

(e1)

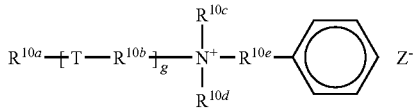

(e2)

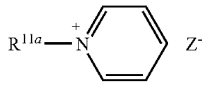

(e3)

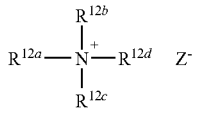

[wherein, $R^{10a}$ and $R^{11a}$ are alkyl or alkenyl groups having 5 to 16 carbon atoms, preferably 6 to 14 carbon atoms, and are preferably alkyl groups; $R^{10c}$ and $R^{10d}$ are alkyl or hydroxyalkyl groups having 1 to 3 carbon atoms; T is —COO—, —OCO—, —CONH—, —NHCO—, or

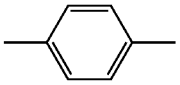

; g is a number of 0 or 1; $R^{10b}$ is an alkylene group having 1 to 6 carbon atoms or $—(O—R^{10f})_e—$, wherein $R^{10f}$ is an ethylene or propylene group, preferably an ethylene group, and e is a number of 1 to 10, preferably 1 to 5; $R^{10e}$ is an alkylene group having 1 to 5 carbon atoms, preferably 2 or 3 carbon atoms; among $R^{12a}$, $R^{12b}$, $R^{12c}$ and $R^{12d}$, two or more (preferably two) of them are alkyl groups having 8 to 12 carbon atoms, and the rest are alkyl or hydroxyalkyl groups having 1 to 3 carbon atoms; and $Z^-$ is an anion group, preferably a halogen ion or an alkylsulfate ion having 1 to 3 carbon atoms.]

Preferred examples of the cationic surfactant in the present invention include the following.

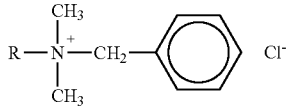

[wherein, R is an alkyl group having 8 to 12 carbon atoms.]

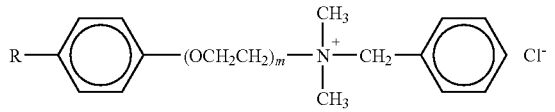

[wherein, R is an optionally branched alkyl group having 6 to 10 carbon atoms; and m is a number of 1 to 5.]

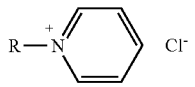

[wherein, R is an alkyl group having 8 to 12 carbon atoms.]

In the present invention, in order to improve the detergency effect and due to preventive effects against separation and becoming clouded of the hydrophobic solvent as component (c) at a low or high temperature, a glycol solvent (hereinafter, referred to as component (f)) is preferably used together. Specifically, compounds represented by formula (f1) are preferably used.

$$R^{9a}—(OR^{9b})_f—OH \quad (f1)$$

[wherein, $R^{9a}$ is a hydrocarbon group having 1 to 7 carbon atoms, preferably 2 to 5 carbon atoms; f is a number of 1 to 5, preferably 1 to 4; and $R^{9b}$ is an alkylene group having 2 or 3 carbon atoms.]

Specific examples of a preferred compound include the followings:

ethylene glycol monomethyl ether, ethylene glycol monoethyl ether, ethylene glycol monopropyl ether, ethylene glycol monobutyl ether, ethylene glycol monophenyl ether, ethylene glycol monobenzyl ether, diethylene glycol monomethyl ether, diethylene glycol monoethyl ether, diethylene glycol monopropyl ether, diethylene glycol monobutyl ether, diethylene glycol monohexyl ether, diethylene glycol monophenyl ether, diethylene glycol monobenzyl ether, propylene glycol monomethyl ether, propylene glycol monoethyl ether, propylene glycol monopropyl ether, propylene glycol monobutyl ether, propylene glycol monohexyl ether, dipropylene glycol monomethyl ether, dipropylene glycol monoethyl ether, dipropylene glycol monopropyl ether, dipropylene glycol monobutyl ether, polyoxypropylene (average added mole number: 3 to 5) monomethyl ether, polyoxypropylene (average added mole number: 3 to 5) monoethyl ether, polyoxyethylene (average added mole number: 1 to 5) monophenyl ether, polyoxyethylene (average added mole number: 1 to 5) monobenzyl ether.

In the present invention, as component (f), ethylene glycol monobutyl ether, diethylene glycol monobutyl ether, diethylene glycol monohexyl ether, propylene glycol monobutyl ether, and dipropylene glycol monobutyl ether are preferred, and diethylene glycol monobutyl ether is even more preferred.

In the present invention, in order to further improve detergency, a sequestering agent (hereinafter, referred to as component (g)) is preferably contained. Examples of the sequestering agent used in the present invention include:

(1) phosphoric acid compounds such as phytic acid or an alkali metal or alkanolamine salts thereof;

(2) ethane-1,1-diphosphonic acid, ethane-1,1,2-triphosphonic acid, ethane-1-hydroxy-1,1-diphosphonic acid, and derivatives thereof, and phosphonic acid such as ethane hydroxy-1,1,2-triphosphonic acid, ethane-1,2-dicarboxy-1,2-diphosphonic acid, and methanehydroxyphosphonic acid, or an alkali metal or alkanolamine salts thereof;

(3) phosphonocarboxylic acids such as 2-phosphonobutane-1,2-dicarboxylic acid, 1-phosphonobutane-2,3,4-tricarboxylic acid, and α-methylphosphonosuccinic acid or an alkali metal or alkanolamine salts thereof;

(4) amino acids such as aspartic acid, glutamic acid, and glycine or an alkali metal or alkanolamine salts thereof;

(5) aminopolyacetic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraaminehexaacetic acid, djenkolic acid, alkylglycine-N,N-diacetic acid, aspartic acid-N,N-diacetic acid, serine-N,N-diacetic acid, glutamic acid diacetate, and ethylenediaminesuccinic acid or salts thereof, preferably an alkali metal or alkanolamine salts thereof;

(6) organic acids such as diglycolic acid, oxydisuccinic acid, carboxymethyloxysuccinic acid, citric acid, lactic acid, tartaric acid, oxalic acid, malic acid, oxydisuccinic acid, gluconic acid, carboxymethylsuccinic acid, and carboxy methyltartaric acid, or an alkali metal or alkanolamine salts thereof;

(7) an alkali metal or alkanolamine salts of aluminosilicate in which zeolite A is a typical example; and (8) aminopoly(methylenephosphonic acid) and an alkali metal or alkanolamine salts thereof; or polyethylenepolyaminepoly (methylenephosphonic acid) or an alkali metal or alkanolamine salts thereof.

Among them, at least one selected from (2), (5), (6), and (7) is preferred, and at least one selected from (5) and (6) is more preferred. Specifically, sodium ethylenediaminetetraacetate and trisodium citrate are even more preferred.

In the present invention, from the point of detergency, an alkali agent (hereinafter, referred to as component (h)) is preferably contained. Examples of the alkali agent include sodium carbonate, potassium carbonate, sodium hydroxide, potassium hydroxide, ammonia, monoethanolamine, diethanolamine, N-methylpropanol, 2-amino-2-methyl-1-propanol, N-(β-aminoethyl) ethanolamine, diethylenetriamine, morpholine, and N-ethylmorpholine. As the alkali agent used in the present invention, monoethanolamine, 2-amino-2-methyl-1-propanol and morpholine are even more preferred.

The liquid detergent composition of the present invention is preferably pH 2 to 12, more preferably 3 to 11 at 20° C., from the point of detergency effect. As a pH adjusting agent, acidic agents including inorganic acids such as hydrochloric acid and sulfuric acid and organic acids such as citric acid, succinic acid, malic acid, fumaric acid, tartaric acid, malonic acid, and maleic acid, and alkali agents described above are preferably used alone or in combination. An acid selected from hydrochloric acid, sulfuric acid, and citric acid, and an alkali agent selected from sodium hydroxide, potassium hydroxide, and amine compounds above are particularly preferably used. From the point of usability, the composition of the present invention preferably has a viscosity of 1 to 100 mPa·s, more preferably 1 to 50 mPa·s at 20° C. As used herein, the viscosity is a value obtained by incubating a sample for 30 minutes in a thermostat bath at 20° C. and measuring with a B-type viscometer model BM manufactured by TOKIMEC. INC.

The composition of the present invention may combine polyalkylene glycol for preventing gelation. Specific examples of the polyalkylene glycol for preventing gelation include polypropylene glycol and polyethylene glycol, which have weight average molecular weights of 500 to 20000 determined by gel permeation chromatography using polyethylene glycol as a standard.

The liquid detergent composition of the present invention may add other components than described above according to need, including a dispersing agent, a chelating agent, a hydrotrope agent, a flavorant, a dye, a pigment, and a preservative, which are generally used, within the scope that does not impair the effects of the Invention.

<Liquid Detergent Composition>

An emulsification or dispersion with a nonionic surfactant and the like are generally known. However, even when an appropriate nonionic surfactant is used, considering with HLB and the like, the nonionic surfactant is generally required in about three times as much an amount by weight as the hydrophobic solvent as component (c). In addition, detergency of the composition is not a level expected from a content of component (c), but quite reduced. According to the present invention, the total amount of components (a) that is a specific nonionic compound required for homogenizing the same amount of the hydrophobic solvent of component (c) and (b) that is an anionic surfactant and/or an amphoteric surfactant can be reduced to 2.5-fold or less (weight ratio), particularly to 1.75-fold or less, while detergency of (c) can be very satisfactorily achieved. Within the scope in which (c) can be uniformly cleared, the less amount of the total of (a) and (b) provides higher detergency. The present invention has solved the problem of combining an aqueous solution of component (c) without impairing its properties by using a specific compound [component (a)] having one alkyl group selected from a 2-ethylhexyl group, an isononyl group, and an isodecyl group and a specific surfactant [component (b)] together. Although the mechanism thereof is not clarified, it is thought that component (a) has a different balance of hydrophobicity and hydrophilicity and a different branched structure from general surfactants, and thus is difficult to form a robust micelle having a small curvature and a structure of including the hydrophobic solvent by component (a) alone, but is more likely to combine itself with component (b) to form a large and flexible interface film and a relatively large structure. It is a matter for speculation about the size of the structure, but the hydrophobic solvent might form a continuous layer as a bicontinuous structure in some cases.

JP-A-06-306400 discloses the use of a near-tricritical point composition as a detergent containing (1) an amphiphatic substance such as triethylene glycol monohexyl ether, (2) a nonpolar or weakly polar solvent such as hydrocarbon, and (3) a polar solvent such as water. In Examples of the patent, an amount of the nonpolar or weakly polar solvent added is as much as 27 to 47.6% by weight. JP-A-2002-20791 discloses a liquid detergent that forms a bicontinuous phase. However, a hydrophobic component used is highly polar, and sufficient detergency cannot be achieved. In WO 01/059059, when the surfactant described is used, strong microemulsion is formed to stabilize oil. The oil and the surfactant therefore cannot exhibit their good detergency.

According to the present invention, by using a combination of (a) and (b), high detergency can be provided with a relatively small amount of component (c) added (e.g., 20% or less by weight).

Moreover, by using a construction of the present invention, simultaneous use of an amphiphatic solvent as component (g) does not affect properties of a hydrophobic solvent, but is more likely to fully achieve both detergencies of component (g) and the hydrophobic solvent.

The features of the present invention will be summarized below. [(a)+(b)]/(c) (mass ratio) is 2.5 or less, preferably 2 or less, and more preferably 1.75 or less. From the point of stability, the lower limit thereof is 0.1 or more, and more preferably 0.2 or more. The smaller value of [(a)+(b)]/(c) (mass ratio) has better detergency, and the higher value has higher stability. (b)/(a) (mass ratio) is 0.1 or more, preferably 0.15 or more, and more preferably 0.2 ore more. The upper limit thereof is preferably 100 or less, more preferably 10 or less, and even more preferably 2 or less. Addition of component (b) in a specific ratio or higher amount to component (a) allows reduction of the concentration of component (a) and stabilization. To sufficiently achieve detergency to oil stains of the hydrophobic solvent as component (c), the content ratio of component (b) to component (a) is preferably not more than a specific ratio. For sufficient stability, (a)/(c) (mass ratio) is 0.1 or more, preferably 0.5 or more, and more preferably 0.7 or more. The upper limit thereof is preferably 2.5 or less, more preferably 2.0 or less, and even more preferably 1.2 or less. [(a)+(b)]/the total surfactants (mass ratio) is 0.7 or more, preferably 0.9 or more, and more preferably 0.95 or more. The upper limit thereof is 1.0 or less, that is, all of the surfactants may be constructed with component (a) and component (b). In the present invention, simultaneous use of a surfactant other than (a) and (b) is limited due to the possibility of reduction in stability and detergency. As used herein, the term "the total surfactants" includes the amount of component (a).

The composition of the present invention is a liquid detergent composition using water as a main solvent. In the liquid detergent composition of the present invention, component (c) is stably contained in a solvent as component (d) without impairing its properties as the hydrophobic solvent, and component (a) is added for stabilization. However, when component (a) alone is used for stabilization, sufficient detergency cannot be achieved. In the present invention, by using component (b) together, the detergent composition can be stable and achieve good detergency with an increased amount of component (a). It is noted that component (c) is solubilized with component (b) by forming a micelle, but detergency of the hydrophobic solvent as component (c) cannot be sufficiently achieved, and detergency of the surfactant itself is also reduced.

Specific concentrations of components in the liquid detergent composition of the present invention are as follows. A concentration of component (c) is preferably 2 to 25% by weight, more preferably 3 to 20% by weight, and even more preferably 5 to 15%. When the amount is fewer, detergency is insufficient. When the amount is larger, the amounts of active agents ((a) and (b)) required are also larger, which is not economic. A concentration of component (d) is preferably 20% or more by weight, more preferably 50% or more by weight, and even more preferably 60% or more by weight. A fewer amount is not economic. When the concentration is 95% or more by weight, the composition is too weak to achieve sufficient detergency performance.

In the present invention, to increase detergency effect and bactericidal effect, component (e) may be contained in the composition in an amount of 0.01 to 1% by mass, and more preferably 0.05 to 2% by mass. From the viewpoints of stabilization with component (a) and component (b) and the original detergency effect of component (c), an amount of component (e) added must be considered such that [(a)+(b)]/the total surfactants (mass ratio) is 0.7 or more.

Component (f) of the present invention is preferably contained in order to increase detergency effect and stability. An amount thereof is preferably 0.1 to 20% by mass, more preferably 1 to 15% by mass, and even more preferably 2 to 15% by mass of the composition.

Component (g) and component (h) are preferably contained in the composition in order to increase detergency effect. From the point of detergency effect, an amount of component (g) is preferably 0.1 to 10% by mass, more preferably 0.3 to 8% by mass, and even more preferably 0.5 to 6% by mass of the composition, and an amount of component (h) is preferably 0.05 to 10% by mass, and even more preferably 0.1 to 8% by mass of the composition.

In the present invention, kinds and amounts added of other components such as a hydrotrope agent and an antigelling agent can be appropriately determined taking into consideration the intended use, stability, usability, and the like.

The liquid detergent composition of the present invention exhibits high detergency to hydrophobic stains of denatured oils, grease, oils, and the like. It can be used either for industrial or domestic use. It is particularly effectively used as a domestic bathroom cleaner for sebum stains and silicone stains in a bathroom and as a kitchen detergent for denatured oils around stoves and a vent fan.

EXAMPLES

The following Examples describe embodiments of the present invention. The Examples are given solely for the purpose of illustration and are not to be construed as limitations of the present invention.

Components used in the following Examples are shown below.

<Components Used> a-1: a compound obtained by adding EO in an average amount of 2 moles to 2-ethyl-1-hexanol a-2: a compound obtained by adding EO in an average amount of 2 moles to isononyl alcohol a-3: a compound obtained by adding EO in an average amount of 2 moles to isodecanol a-4: a compound obtained by adding EO in an average amount of 1 mole to 2-ethyl-1-hexanol a-5: a compound obtained by adding EO in an average amount of 4 moles to 2-ethyl-1-hexanol a-6: 2-ethyl-1-hexyl monoglyceryl ether a-7: isodecyl monoglyceryl ether a'-1: a compound obtained by adding EO in an average amount of 2 moles to n-octanol a'-2: a compound obtained by adding EO in an average amount of 2 moles to n-dodecanol a'-3: n-octyl monoglyceryl ether b-1: dodecyl sulfuric ester sodium b-2: polyoxyethylene (EO adduct with an average added mole number of 4) dodecyl ether sulfuric ester sodium (a dodecyl group: linear)

b-3: a compound (sodium salt) obtained by adding EO in an average amount of 2 moles to Dobanol 23 (trademark) (Mitsubishi Chemical Corporation, a mixture of carbon numbers of 12/13=1/1, containing 20% by mass of branched alkyl), and sulfating b-4: sodium decanoate b-5: sodium laurate b-6: sodium palmitate b-7: Kao Akypo RLM-45NV (trade mark) (Kao Corporation, polyoxyethylene (EO adduct with an average added mole number of 4.5) dodecyl ether sulfuric ester sodium (a dodecyl group: linear))

b-8: Kao Akypo RLM-100NV (trade mark) (Kao Corporation, polyoxyethylene (EO adduct with an average added mole number of 10) dodecyl ether sulfuric ester sodium (a dodecyl group: linear))

b-9: sodium α-olefin sulfonate (a carbon number of olefin: 12)

b-10: Pelex OT-P (trade mark) (Kao Corporation, dialkylsulfosuccinic acid, both of alkyl are 2-ethylhexyl)

b-11: Anhitol 20BS (trade mark) (Kao Corporation, n-dodecyl dimethyl carboxymethyl betaine)

b-12: Anhitol 20AB (trade mark) (Kao Corporation, n-dodecyl amidopropyl dimethyl carboxymethyl betaine)

b-13: Anhitol 20N (trade mark) (Kao Corporation, n-dodecyldimethylamine oxide)

b-14: Softazoline LAO (trade mark) (Kawaken Fine Chemicals Co., Ltd., n-dodecyl amidepropyl dimethylamine oxide)

c-1: dodecane (sp=16.2)

c-2: IP2028 (trade mark) (Idemitsu Sekiyu Kagaku K.K., isoparaffin, sp=14.3)

d-1: water e-1: N-octyl-N,N-dimethyl-N-benzylammonium chloride f-1: diethylene glycol monobutyl ether g-1: sodium ethylenediaminetetraacetate g-2: citric acid h-1: sodium hydroxide h-2: monoethanolamine

Example 1

Liquid detergent compositions shown in Tables 1 to 4 were prepared and evaluated for stability and detergency according to the following evaluation methods. Results are shown in Tables 1 to 4. In some comparative compositions, as a matter of practical convenience, a'-1, a'-2, and a'-3 were regarded as component (a) and used for calculation of [(a)+(b)]/(c), (b)/(a), (a)/(c), and [(a)+(b)]/[(a)+(b)+(e)]. In Comparative composition 1-13, [(a)+(b)]/[(a)+(b)+(e)+(a'-2)] ((a) in a numerator did not contain a'-2, but component (a) in a denominator contained a'-2) was calculated and regarded as [(a)+(b)]/[(a)+(b)+(e)].

<Evaluation Methods>

(1-1) Stability

○; stable clear solution without phase separation occurring or becoming clouded after standing for one month or more at room temperature (10 to 30° C.)

x: phase separation, becoming clouded, and/or precipitation occurred at the same conditions (1-2) Detergency (Detergency to Soap Scum)

A polypropylene basin actually used for three months and having soap scum stuck thereon was rubbed back and forth five times with a polyurethane sponge containing a liquid detergent composition to be evaluated at about 500 g load. The operation was performed 20 times. An average thereof was shown as a result.

5: very good removal of scum

4: good removal of scum

3: nonuniform removal of scum

2: slight removal of scum

1: very little removal of scum (1-3) Detergency (Detergency to Denatured Oil Stains)

A steel plate was uniformly applied with 10 g of oil for tempura, baked for 30 minutes at 180° C., and allowed to stand for three months at room temperature to form an almost dried film thereon, which plate was used as a dirty plate model. About 0.5 mL of liquid detergent composition was dropped on the dirty plate model horizontally fixed, and allowed to stand for 1 minute. Then, floated stains were wiped off with absorbent cotton. The operation was performed 20 times. A degree of cleaning was visually observed and evaluated according to the following grading for each time. An average thereof was shown as a result.

5: perfect removal of stains
4: about 60% to about 80% removal of stains
3: about 50% to about 60% removal of stains
2: about 30% to about 50% removal of stains
1: to about 30% removal of stains
0: no removal of stains

TABLE 1

| | | | Example product | | | | | | | |
|---|---|---|---|---|---|---|---|---|---|---|
| | | | 1-1 | 1-2 | 1-3 | 1-4 | 1-5 | 1-6 | 1-7 | 1-8 |
| Liquid detergent composition | Compound component (% by mass) | (a) a-1 | 7.4 | | 7.1 | 13.1 | | 7.1 | 6.9 | |
| | | a-2 | | 8 | | | | | | |
| | | a-3 | | | | | | | | 5 |
| | | a-6 | | | | | 8 | | | |
| | | (b) b-1 | 2.6 | 4 | | | | | | |
| | | b-2 | | | 2.9 | 7.9 | 4 | | | |
| | | b-3 | | | | | | 8.9 | 3.1 | 5 |
| | | (c) c-1 | 8 | | 8 | 12 | 8 | 8 | 8 | |
| | | c-2 | | 8 | | | | | | 5 |
| | | (d) d-1 | 69 | 67 | 69 | 54 | 67 | 63 | 69 | 72 |
| | | (e) e-1 | | | | | | | | |
| | | (f) f-1 | 8 | 8 | 8 | 8 | 8 | 8 | 8 | 8 |
| | | (g) g-1 | 2 | 2 | 2 | 2 | 2 | 2 | 2 | 2 |
| | | g-2 | 2 | 2 | 2 | 2 | 2 | 2 | 2 | 2 |
| | | (h) h-1 | 1 | 1 | 1 | 1 | 1 | 1 | 1 | 1 |
| | | Total | 100 | 100 | 100 | 100 | 100 | 100 | 100 | 100 |
| | pH (20° C.) | | 7 | 7 | 7 | 7 | 7 | 7 | 7 | 7 |
| | [(a) + (b)]/(c) (ratio by mass) | | 1.25 | 1.50 | 1.25 | 1.75 | 1.50 | 2.00 | 1.25 | 2.00 |
| | (b)/(a) (ratio by mass) | | 0.35 | 0.50 | 0.40 | 0.60 | 0.50 | 1.25 | 0.45 | 1.00 |
| | (a)/(c) (ratio by mass) | | 0.93 | 1.00 | 0.89 | 1.09 | 1.00 | 0.89 | 0.86 | 1.00 |
| | [(a) + (b)]/[(a) + (b) + (e)] (ratio by mass) | | 1 | 1 | 1 | 1 | 1 | 1 | 1 | 1 |
| | Stability | | ○ | ○ | ○ | ○ | ○ | ○ | ○ | ○ |
| | Detergency to soap scum | | 4.8 | 4.6 | 4.8 | 4.6 | 4.7 | 4.0 | 4.8 | 4.0 |

TABLE 2

| | | | Present invention product | | | | | | |
|---|---|---|---|---|---|---|---|---|---|
| | | | 2-1 | 2-2 | 2-3 | 2-4 | 2-5 | 2-6 | 2-7 |
| Liquid detergent composition | Compounded component (% by mass) | (a) a-1 | | 7.7 | | 8 | | 8 | 5.8 |
| | | a-5 | | | 9.3 | | | | |
| | | a-6 | 13.3 | | | | 6 | | |
| | | (b) b-4 | 4.7 | | | | | | |
| | | b-5 | | | 4.7 | 2 | | | |
| | | b-6 | | 2.3 | | | | | |
| | | b-7 | | | | | 6 | | |
| | | b-8 | | | | | | 8 | 2.2 |
| | | (c) c-1 | | 8 | 8 | 8 | 8 | 8 | 8 |
| | | c-2 | 12 | | | | | | |
| | | (d) d-1 | 57 | 69 | 65 | 69 | 67 | 63 | 71 |
| | | (e) e-1 | | | | | | | |
| | | (f) f-1 | 8 | 8 | 8 | 8 | 8 | 8 | 8 |
| | | (g) g-1 | 2 | 2 | 2 | 2 | 2 | 2 | 2 |
| | | g-2 | 2 | 2 | 2 | 2 | 2 | 2 | 2 |
| | | (h) h-1 | 1 | 1 | 1 | 1 | 1 | 1 | 1 |
| | | Total | 100 | 100 | 100 | 100 | 100 | 100 | 100 |
| | pH (20° C.) | | 7 | 7 | 7 | 7 | 7 | 7 | 7 |
| | [(a) + (b)]/(c) (ratio by mass) | | 1.50 | 1.25 | 1.75 | 1.25 | 1.50 | 2.00 | 1.00 |
| | (b)/(a) (ratio by mass) | | 0.35 | 0.30 | 0.50 | 0.25 | 1.00 | 1.00 | 0.37 |
| | (a)/(c) (ratio by mass) | | 1.11 | 0.96 | 1.17 | 1.00 | 0.75 | 1.00 | 0.73 |
| | [(a) + (b)]/[(a) + (b) + (e)] (ratio by mass) | | 1 | 1 | 1 | 1 | 1 | 1 | 1 |
| | Stability | | ○ | ○ | ○ | ○ | ○ | ○ | ○ |
| | Detergency to soap scum | | 4.7 | 4.8 | 4.4 | 4.8 | 4.6 | 4.0 | 4.9 |

TABLE 3

| | | | | Present invention product | | | | | | |
|---|---|---|---|---|---|---|---|---|---|---|
| | | | | 3-1 | 3-2 | 3-3 | 3-4 | 3-5 | 3-6 | 3-7 |
| Liquid detergent composition | compounded component (% by mass) | (a) | a-1 | | | | 7.1 | | | |
| | | | a-2 | | 7.1 | | | | | |
| | | | a-4 | | | 5.7 | | | 7.1 | |
| | | | a-5 | | | | | 5 | | |
| | | | a-7 | 12 | | | | | | 11.7 |
| | | (b) | b-9 | 12 | | | | | | |
| | | | b-10 | | 8.9 | | | | | |
| | | | b-11 | | | 4.3 | | | | |
| | | | b-12 | | | | 4.9 | 5 | | |
| | | | b-13 | | | | | | 4.9 | |
| | | | b-14 | | | | | | | 9.3 |
| | | (c) | c-1 | 12 | | 5 | 8 | | | 12 |
| | | | c-2 | | 8 | | | 5 | 8 | |
| | | (d) | d-1 | 51 | 63 | 71.5 | 66.8 | 71.8 | 66.8 | 53.5 |
| | | (e) | e-1 | | | 0.5 | 0.2 | 0.2 | 0.2 | 0.5 |
| | | (f) | f-1 | 8 | 8 | 8 | 8 | 8 | 8 | 8 |
| | | (g) | g-1 | 2 | 2 | 2 | 2 | 2 | 2 | 2 |
| | | | g-2 | 2 | 2 | 2 | 2 | 2 | 2 | 2 |
| | | (h) | h-1 | 1 | 1 | 1 | 1 | 1 | 1 | 1 |
| | | | Total | 100 | 100 | 100 | 100 | 100 | 100 | 100 |
| | pH (20° C.) | | | 7 | 7 | 7 | 7 | 7 | 7 | 7 |
| | [(a) + (b)]/(c) (ratio by mass) | | | 2.00 | 2.00 | 2.00 | 1.50 | 2.00 | 1.50 | 1.75 |
| | (b)/(a) (ratio by mass) | | | 1.00 | 1.25 | 0.75 | 0.70 | 1.00 | 0.70 | 0.80 |
| | (a)/(c) (ratio by mass) | | | 1.00 | 0.89 | 1.14 | 0.88 | 1.00 | 0.88 | 0.97 |
| | [(a) + (b)]/[(a) + (b) + (e)] (ratio by mass) | | | 1 | 1 | 0.95 | 0.98 | 0.98 | 0.98 | 0.98 |
| | Stability | | | ○ | ○ | ○ | ○ | ○ | ○ | ○ |
| | Detergency to soap scum | | | 4.1 | 3.9 | 3.9 | 4.7 | 4.0 | 4.7 | 4.6 |

TABLE 4

| | | | | Present invention product | | | | | |
|---|---|---|---|---|---|---|---|---|---|
| | | | | 4-1 | 4-2 | 4-3 | 4-4 | 4-5 | 4-6 |
| Liquid detergent composition | Compounded component (% by mass) | (a) | a-1 | 7.4 | 6.9 | 5.8 | | | |
| | | | a-2 | | | | | 7.1 | |
| | | | a-4 | | | | | | 7.1 |
| | | | a-7 | | | | 12 | | |
| | | (b) | b-1 | 2.6 | | | | | |
| | | | b-3 | | 3.1 | | | | |
| | | | b-8 | | | 2.2 | | | |
| | | | b-9 | | | | 12 | | |
| | | | b-10 | | | | | 8.9 | |
| | | | b-13 | | | | | | 4.9 |
| | | (c) | c-1 | 8 | 8 | 8 | 12 | | |
| | | | c-2 | | | | | 8 | 8 |
| | | (d) | d-1 | 69.5 | 69.5 | 71.5 | 51.5 | 63.5 | 67.3 |
| | | (e) | e-1 | | | | | | 0.2 |
| | | (f) | f-1 | 8 | 8 | 8 | 8 | 8 | 8 |
| | | (g) | g-1 | 2 | 2 | 2 | 2 | 2 | 2 |
| | | | g-2 | 2 | 2 | 2 | 2 | 2 | 2 |
| | | (h) | h-2 | 0.5 | 0.5 | 0.5 | 0.5 | 0.5 | 0.5 |
| | | | Total | 100 | 100 | 100 | 100 | 100 | 100 |
| | pH (20° C.) | | | 11 | 11 | 11 | 11 | 11 | 11 |
| | [(a) + (b)]/(c) (ratio by mass) | | | 1.25 | 1.25 | 1 | 2.00 | 2.00 | 1.50 |
| | (b)/(a) (ratio by mass) | | | 0.35 | 0.45 | 0.37 | 1.00 | 1.25 | 0.70 |
| | (a)/(c) (ratio by mass) | | | 0.93 | 0.86 | 0.73 | 1.00 | 0.89 | 0.88 |
| | [(a) + (b)]/[(a) + (b) + (e)] (ratio by mass) | | | 1 | 1 | 1 | 1 | 1 | 0.98 |
| | Stability | | | ○ | ○ | ○ | ○ | ○ | ○ |
| | Detergency to denatured oil stains | | | 4.7 | 4.7 | 4.9 | 4.2 | 4.0 | 4.5 |

TABLE 5

| | | | Comparative product | | | | | | |
|---|---|---|---|---|---|---|---|---|---|
| | | | 1-1 | 1-2 | 1-3 | 1-4 | 1-5 | 1-6 | 1-7 |
| Liquid detergent composition | Compounded component (% by mass) | (a) a-1 | | 0.4 | | | | 16 | |
| | | a'-1 | | | 6.9 | | | | |
| | | a'-2 | | | | 7.7 | | | 24 |
| | | a'-3 | | | | | 8 | | |
| | | (b) b-1 | | 9.6 | | | | | |
| | | b-2 | | | | | 4 | | |
| | | b-3 | 16 | | 3.1 | | | | |
| | | b-5 | | | | | | | |
| | | b-6 | | | | 2.3 | | | |
| | | b-8 | | | | | | | |
| | | (c) c-1 | 8 | 8 | 8 | 8 | 8 | 8 | 8 |
| | | (d) d-1 | 63 | 69 | 69 | 69 | 67 | 63 | 55 |
| | | (e) e-1 | | | | | | | |
| | | (f) f-1 | 8 | 8 | 8 | 8 | 8 | 8 | 8 |
| | | (g) g-1 | 2 | 2 | 2 | 2 | 2 | 2 | 2 |
| | | g-2 | 2 | 2 | 2 | 2 | 2 | 2 | 2 |
| | | (h) h-1 | 1 | 1 | 1 | 1 | 1 | 1 | 1 |
| | Total | | 100 | 100 | 100 | 100 | 100 | 100 | 100 |
| | pH (20° C.) | | 7 | 7 | 7 | 7 | 7 | 7 | 7 |
| | [(a) + (b)]/(c) (ratio by mass) | | 2.00 | 1.25 | 1.25 | 1.25 | 1.50 | 2.00 | 3 |
| | (b)/(a) (ratio by mass) | | (∞) | 24 | 0.45 | 0.30 | 0.50 | 0 | 0 |
| | (a)/(c) (ratio by mass) | | 0 | 0.05 | 0.86 | 0.96 | 1.00 | 2.00 | 3 |
| | [(a) + (b)]/[(a) + (b) + (e)] (ratio by mass) | | 1 | 1 | 1 | 1 | 1 | 1 | 1 |
| | Stability | | X | X | X | X | X | X | ○ |
| | Detergency to soap scum | | 1.9 | 2.1 | 2.3 | 2.2 | 2.1 | 2.5 | 1.9 |

| | | | Comparative product | | | | | |
|---|---|---|---|---|---|---|---|---|
| | | | 1-8 | 1-9 | 1-10 | 1-11 | 1-12 | 1-13 |
| Liquid detergent composition | Compounded component (% by mass) | (a) a-1 | 9.5 | 5.8 | 17.8 | 40 | 7.1 | 7.1 |
| | | a'-1 | | | | | | |
| | | a'-2 | | | | | | 7.5 |
| | | a'-3 | | | | | | |
| | | (b) b-1 | | | 6.2 | 14 | | |
| | | b-2 | | | | | 2.9 | |
| | | b-3 | | | | | | 8.9 |
| | | b-5 | 0.5 | | | | | |
| | | b-6 | | | | | | |
| | | b-8 | | 2.2 | | | | |
| | | (c) c-1 | 8 | 0 | 8 | 18 | 8 | 8 |
| | | (d) d-1 | 69 | 79 | 55 | 15 | 63.6 | 55.5 |
| | | (e) e-1 | | | | | 5.4 | |
| | | (f) f-1 | 8 | 8 | 8 | 8 | 8 | 8 |
| | | (g) g-1 | 2 | 2 | 2 | 2 | 2 | 2 |
| | | g-2 | 2 | 2 | 2 | 2 | 2 | 2 |
| | | (h) h-1 | 1 | 1 | 1 | 1 | 1 | 1 |
| | Total | | 100 | 100 | 100 | 100 | 100 | 100 |
| | pH (20° C.) | | 7 | 7 | 7 | 7 | 7 | 7 |
| | [(a) + (b)]/(c) (ratio by mass) | | 1.25 | (∞) | 3 | 3 | 1.25 | 2.00 |
| | (b)/(a) (ratio by mass) | | 0.05 | 0.37 | 0.35 | 0.35 | 0.4 | 1.25 |
| | (a)/(c) (ratio by mass) | | 1.18 | (∞) | 2.23 | 2.22 | 0.89 | 0.89 |
| | [(a) + (b)]/[(a) + (b) + (e)] (ratio by mass) | | 1 | 1 | 1 | 1 | 0.65 | 0.68 |
| | Stability | | X | ○ | ○ | ○ | X | X |
| | Detergency to soap scum | | 2.5 | 1.2 | 1.9 | 1.7 | 2.1 | 2.3 |

The invention claimed is:

1. A liquid detergent composition comprising:

(a) at least one compound selected from the group consisting of a compound (a1) and a compound (a2), wherein the compound (a1) is a polyoxyalkylene alkyl ether having one alkyl group selected from the group consisting of a 2-ethylhexyl group, an isononyl group and an isodecyl group, wherein an average added mole number of alkylene oxides having 2 or 3 carbon atoms is 2 to 6, and wherein the compound (a2) is a compound represented by formula (I)

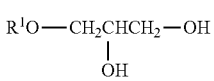

(I)

wherein $R^1$ is an alkyl group selected from the group consisting of a 2-ethylhexyl, an isodecyl, and an isononyl group, (b) at least one surfactant selected from the group consisting of an anionic surfactant and an amphoteric surfactant, (c) a hydrophobic organic solvent that is liquid at 20° C., has a solubility parameter of 10.0 to 21.0 and a solubility in water at 20° C. of 0.5% by mass or less, (d) water, (f) a glycol solvent, and (e) optionally, one or more surfactants other than component (a) and component (b), wherein

[(a)+(b)]/(c) (mass ratio) is 1.75 or less, (b)/(a) (mass ratio) is 0.1 or more, (a)/(c) (mass ratio) is 0.7 or more, and

[(a)+(b)]/the total surfactants (mass ratio) is 0.95 to 1, and wherein the total surfactants is the sum of (a)+(b)+(e).

2. The liquid detergent composition according to claim 1, wherein component (b) is at least one compound selected from the group consisting of a compound (31), a compound (b2), a compound (b3) and a compound (b4); wherein the compound (b1) is an alkyl sulfuric ester salt represented by formula (1b)

$$R^2OSO_3M^2 \quad (1b)$$

wherein $R^2$ represents a linear or branched alkyl or alkenyl group having 8 to 22 carbon atoms, and $M^2$ represents a hydrogen atom, an alkali metal, ammonia or an alkanolamine;

the compound (b2) is a polyoxyethylene alkyl ether sulfuric ester salt represented by formula (2b)

$$R^3(OCH_2CH_2)_nOSO_3M^3 \quad (2b)$$

wherein $R^3$ represents an alkyl or alkylallyl group having 8 to 22 carbon atoms, n represents an integer of 0 to 16, and $M^3$ represents a hydrogen atom, an alkali metal, ammonia or an alkanolamine;

the compound (b3) is a fatty acid or a salt thereof represented by formula (3b)

$$R^4COOM^4 \quad (3b)$$

wherein $R^4$ represents a linear or branched alkyl or alkenyl group having 7 to 17 carbon atoms, and $M^4$ represents a hydrogen atom, an alkali metal, ammonia or an alkanolamine; and the compound (b4) is an ether carboxylic acid salt represented by formula (4b)

$$R^5(OCH_2CH_2)_nOCH_2COOM^5 \quad (4b)$$

wherein $R^5$ represents an alkyl or alkylallyl group having 8 to 22 carbon atoms, n represents an integer of 0 to 16, and $M^5$ represents a hydrogen atom, an alkali metal, ammonia or an alkanolamine.

3. The liquid detergent composition according to claim 1, wherein component (b) is at least one compound selected from the group consisting of a compound (b5) and a compound (b6); wherein the compound (b5) is a carboxybetaine surfactant represented by formula (5b)

$$R^{6a}-[D-R^{6b}]_f-\underset{R^{6d}}{\overset{R^{6c}}{N^+}}-R^{6e}-COOM^6 \quad (5b)$$

wherein $R^{6a}$ is an alkyl or alkenyl group having 9 to 23 carbon atoms; $R^{6b}$ is an alkylene group having 1 to 6 carbon atoms; D is a group selected from the group consisting of —COO—, —CONH—, —OCO—, —NHCO—, and —O—; f is a number of 0 or 1; $R^{6c}$ and $R^{6d}$ are an alkyl or hydroxyalkyl group having 1 to 3 carbon atoms; $R^{6e}$ is an alkylene group having 1 to 5 carbon atoms that may be substituted with a hydroxy group; and $M^6$ represents a hydrogen atom, an alkali metal, ammonia or an alkanolamine; and the compound (b6) is an amine oxide surfactant represented by formula (6b)

$$R^{7a}-[B-R^{7b}]_e-\underset{R^{7d}}{\overset{R^{7c}}{N^+}}-O^- \quad (6b)$$

wherein $R^{7a}$ is an linear alkyl or alkenyl group having 8 to 16 carbon atoms; $R^{7c}$ and $R^{7d}$ are an alkyl or hydroxyalkyl group having 1 to 3 carbon atoms; $R^{7b}$ is an alkylene group having 1 to 5 carbon atoms; B is a group selected from the group consisting of —COO—, —CONH—, —OCO—, —NHCO— and —O—; and e is a number of 0 or 1.

4. The liquid detergent composition according to claim 1, wherein component (c) is a paraffin compound having a 50% distillation temperature of 150 to 360° C. in accordance with the distillation test of JIS K 2254.

5. The liquid detergent composition according to claim 1, which comprises said component (c) in an amount of no more than 15 mass %.

6. A method for washing a hard surface comprising applying the liquid detergent composition according to claim 1 to the hard surface.

7. The liquid detergent composition according to claim 4, which comprises said component (c) in an amount of no more than 15 mass %.

8. A method for washing a hard surface comprising applying the liquid detergent composition according to claim 2 to the hard surface.

9. The liquid detergent composition according to claim 1, wherein [(a)+(b)]/(c) (mass ratio) is 0.2 to 1.75.

10. The liquid detergent composition according to claim 1, wherein component (e) is present.

11. The liquid detergent composition according to claim 1, further comprising (g) a sequestering agent.

12. The liquid detergent composition according to claim 1, further comprising (h) an alkali agent.

13. The liquid detergent composition according to claim 1, wherein component (c) is dodecane or isoparaffin.

14. The liquid detergent composition according to claim 1, wherein component (f) is diethylene glycol monobutyl ether.

15. The liquid detergent composition according to claim 11, wherein component (g) is sodium ethylenediaminetetraacetate and/or citric acid.

16. The liquid detergent composition according to claim 12, wherein component (h) is sodium hydroxide.

17. The liquid detergent composition according to claim 10, wherein components (a), (b) and (e) which component (e) is a cationic surfactant, are the only surfactants.

18. The liquid detergent composition according to claim 1, wherein (b)/(a) (mass ratio) is 0.2 or more.

* * * * *